United States Patent [19]

El-Shazly et al.

[11] 4,374,876

[45] Feb. 22, 1983

[54] PROCESS FOR THE IMMERSION DEPOSITION OF GOLD

[75] Inventors: Mohamed F. El-Shazly, Bloomfield; Kenneth D. Baker, Bridgewater; Yvonne Rymwid, West Paterson, all of N.J.

[73] Assignee: Occidental Chemical Corporation, Warren, Mich.

[21] Appl. No.: 269,445

[22] Filed: Jun. 2, 1981

[51] Int. Cl.[3] ..... C23C 3/02

[52] U.S. Cl. ..... 427/443.1; 106/1.23; 106/1.26; 427/437

[58] Field of Search ..... 106/1.23, 1.26; 204/46 G; 427/437, 443.1

[56] References Cited

U.S. PATENT DOCUMENTS

| | | | |
|---|---|---|---|
| 2,836,515 | 5/1958 | McNally | 427/436 |
| 2,995,473 | 8/1961 | Levi | 117/201 |
| 3,214,292 | 10/1965 | Edson | 117/227 |
| 3,589,916 | 6/1971 | McCormack | 106/1 |
| 3,598,706 | 8/1971 | Freedman et al. | 204/46 G |
| 3,697,296 | 10/1972 | Bellis | 106/1 |
| 3,700,469 | 10/1972 | Okinaka | 106/1 |
| 3,862,850 | 1/1975 | Trueblood | 427/437 |
| 3,917,885 | 11/1975 | Baker | 427/304 |
| 3,993,808 | 11/1976 | Inaba et al. | 427/377 |
| 4,168,214 | 9/1979 | Fletcher et al. | 204/46 G |

OTHER PUBLICATIONS

Rich, Proc. Amer. Electroplat. Soc., 58 (1971).

Okinaka et al, Plating, 58 (1971) p. 1080.

*Primary Examiner*—Lorenzo B. Hayes

*Attorney, Agent, or Firm*—Richard P. Mueller

[57] ABSTRACT

An electroless plating process for depositing gold on substrates, such as metal and metallized substrates, which involves immersing the substrates in an electroless plating bath composed of a trivalent gold complex, an organic carboxylic acid, and/or a mineral acid sufficient in amount so that the pH of the bath will range from about 0.1 to 6.0. The process of utilizing said electroless bath to deposit gold on the aforementioned substrates is also disclosed and claimed.

8 Claims, No Drawings

PROCESS FOR THE IMMERSION DEPOSITION OF GOLD

FIELD OF THE INVENTION

The present invention relates to an improved electroless plating bath for depositing gold on various substrates including metals and metallized ceramics.

BACKGROUND OF THE INVENTION

Electroless deposition of metals is a process in which the deposition of the metal takes place without the use of external current. The term electroless plating is not very precise. Both autocatalytic reduction and immersion deposition often are referred to as electroless plating. Electroless gold plating has an advantage over electroplated gold due to its ability to plate parts which have discreet and isolated areas; whereas, the electroplating techniques are difficult or impossible to utilize under such conditions.

Immersion or displacement occurs when one metal displaces another from the solution. This displacement is controlled by the potential or reduction potential of the metals under the reaction conditions. Generally, metals with negative potentials (active metals) have a greater tendency to form ions in solutions than those with less negative potentials, i.e., more positive. This process ceases after the surface of the bare metal is completely coated; however, in some cases the thickness of the deposits is thicker than expected for molecular deposit. This behavior can be explained on the basis that the mechanism of the displacement reaction at the surface of the metal is not homogeneous in nature. If the surface consists of areas which are more active and then others which are less active (more noble), the more active sites form anodic centers while the less active ones form a cathodic center. Therefore, immersion deposition is a galvanic displacement reaction with a mixed potential reaction consisting of cathodic and anodic half-reactions in much the same manner as a corrosion reaction. At any instant, during the reaction the cathodic and anodic sites must be distributed side by side on a microscopic scale on the substrate surface. Accordingly, gold will deposit at the cathodic sites while the substrate oxidation will take place at the anodic site. It is generally recognized that for any metal deposition system, a strong atom-to-surface interaction will result in the formation of a high density of nuclei, while a weak interaction will give widely spaced nuclei. The deposits obtained from the galvanic displacement are usually a porous deposit.

In recent years a fairly substantial literature has developed with respect to the electroless method of gold plating on surfaces. U.S. patents of special interest both as to the electroless gold plating method and the problems associated with this procedure include; U.S. Pat. Nos. 3,589,916 (McCormack); 3,697,296 (Bellis); 3,700,469 (Okinaka); 3,917,885 (Baker); as well as the earlier patents and articles cited therein. Relevant articles include: Rich, D. W., Proc. American Electroplating Society, 58 (1971); Y. Okinaka, Plating 57, 914 (1970); and Y. Okinaka and C. Wolowodink, Plating 58, 1080 (1971). This body of literature is pertinent to the present invention insofar as it discloses alkali metal cyanides as the source of the gold or related metal in the electroless bath as well as the use of alkali metal borohydrides and amine boranes as reducing agents. Thus, for example, the 1970 article by Okinaka as well as his U.S.

Pat. No. 3,700,469 describes an electroless gold plating bath having the following ingredients:

(1) soluble alkali metal gold complex;

(2) excess free cyanide such as potassium cyanide;

(3) an alkaline agent such as potassium hydroxide; and (4) a borohydride or an amine borane.

The 1971 article by Okinaka et al. as well as Baker's U.S. Pat. No. 3,917,885 point out the problems associated with the use of these particular plating baths, particularly when the cyanide concentrations increase. Other problems were encountered when bath replenishment was carried out and the instability of the baths when the plating rate of about 2.5 microns was approached. There was also a need to avoid undesirable gold precipitation from the baths.

In U.S. Pat. No. 3,917,885 the problems noted above were overcome by utilizing, as the gold or related metals source, an alkali metal imide complex formed from certain special imides. In order to maintain the electroless gold plating at the desired pH of about 11 to 14, the Baker patent suggests the addition to the bath of alkali metal buffering salts such as the citrates, etc.

It is also possible to classify the prior art pertaining to immersion gold deposition into two categories, based on the pH of the bath:

A. Neutral or alkaline Media (pH 7–13)

These are the most common baths which contain gold salt as $K[Au(CH)_2]$ or gold chloride in the presence of alkali metal carbonate or hydroxide and chelating agents, such as, citrate or EDTA.

B. Acid Baths (pH 6 or less)

There are very few disclosed patents dealing with the immersion deposition of gold in acid media. The first acid immersion gold (pH 3.0–6.0) were developed in the middle of the late 1950s. McNally U.S. Pat. No. 2,836,515 patented a process for a mixture of gold chloride, citrate and free HCl (pH 0.3–1.0) for gold deposition on silver plated copper foil. Edson U.S. Pat. No. 3,214,292 investigated acid solutions and obtained deposits up to 20 microinches on germanium diodes using a sulfuric acid bath at a pH of 2.5–3.0. C. A. Levi U.S. Pat. No. 2,995,473 used a similar acid gold solution with hydrofluoric acid at pH less than 3.0. Acid citrate immersion golds (pH 6–7) were discovered to produce coating thicknesses of 7–8 microinches in 20 minutes.

Oda and Hayashi developed an electroless gold plating solution containing cobalt chloride as a catalyst and thiourea as complexing/reducing agents. A deposition rate of 5 microns/1 hour was reported on nickel and Kovar at pH 6–7; however, Okinaka found that his bath can deposit gold on gold substrate. Therefore, this bath can be considered as an autocatalytic electroless process more than an immersion process.

On the other hand, one of the most used applications of electroless deposition in the electronics industry is direct plating of gold on refractory metals. Inaba et al. U.S. Pat. No. 3,993,808 investigated direct plating of gold onto tungsten and molybdenum. The developed bath utilized potassium gold cyanide, potassium tetrachloroaurate in the presence of metal salts such as $NiCl_2$ and $ZnCl_2$ and complexing agent, EDTA, in alkaline media (pH 8–12). R. Tureblood U.S. Pat. No. 3,862,850 claimed a process for electroless gold deposition with thickness of 2–3 microns on refractory metals.

The developed plating process is composed of potassium gold cyanide and an organic chelating agent in buffering media (pH 13.0–13.7).

OBJECTS OF THE INVENTION

One object of the present invention is to provide an electroless gold plating bath which overcomes the disadvantages of the prior art baths.

Another object of the present invention is to provide an electroless gold plating bath which will deposit gold on a variety of metallic substrates.

A further object of the present invention is to provide an electroless gold plating bath which will deposit gold on ceramic substrates which have been pretreated to effect metallization.

A still further object of the present invention is to provide an electroless gold plating bath which will deposit gold on substrates with markedly improved thickness and good thickness while maintaining good stability.

These and other objects of the invention will become readily apparent from the ensuing description of the invention.

SUMMARY OF THE INVENTION

In accordance with the present invention it has now been found that an improved electroless gold plating bath and gold plating procedure can be attained by utilizing a trivalent gold complex in combination with an organic carboxylic acid and/or a mineral acid in an amount which will maintain the pH in a range of from about 0.1 to 6.0 and preferably from about 0.2 to 4.0.

Another aspect of the invention resides in adding a metal catalyst component such as cobalt, nickel or iron to the bath.

In general, the bath will be operated at a temperature within the range of from about 20 degrees C., up to the boiling point of the bath, and preferably from about 50 degrees to 85 degrees C.

Gold deposits ranging from about 0.5 to 12 microns are typical of those which can be achieved by practicing the present invention.

The electroless bath can readily be replenished by the addition of more of the same trivalent gold complex used to make up the bath or a different trivalent gold complex. These complexes may be added as such or formed in situ in the baths.

In accordance with a unique characteristic of the plating baths of the present invention a variety of substrates can be plated with gold utilizing the immersion procedures. Thus, for example, metallized ceramics as well as metals may be plated. With the former, it is generally preferred to preclean prior to coating and utilize a bath pH of from about 0.2 to 3.

As also described above, the electroless plating baths of this invention may be employed to deposit gold directly on nickel and other metals which previously had a tendency to destabilize autocatalytic or electroless plating even at levels of 10 ppm. For some metal substrates it may be desirable to pretreat them by heating to a temperature of at least 100 degrees C.

It also has been found advantageous in some instances to employ a metal catalyst as one of the bath components when plating either metal substrates of metallized ceramic substrates. Such metal catalysts have not been found to be essential for the satisfactory operation of the baths of the present invention.

DETAILED DESCRIPTION OF THE INVENTION

As previously described, the essential feature of the present invention is to formulate a very effective immersion/electroless plating bath for depositing gold on a variety of substrates. The formulation comprises a trivalent gold complex, an organic carboxylic acid, and/or a mineral acid in an amount sufficient so that the pH of the bath will be within the range of about 0.1 to 6.0 and, preferably 0.2 to 4.0.

The trivalent gold complex may be any complex of gold (III) which is soluble in the plating bath and in which the other ions associated with the gold do not have an adverse effect on either the plating bath or its operation. Exemplary of such complexes which may be used are the alkali metal auricyanides and alkali metal gold imides. The complex may be added to the plating bath as such or it may be formed in situ in the bath.

In the latter case, any bath soluble gold (III) compound may be used. Exemplary of such compounds are the alkali metal aurates, alkali metal aurihydroxides, gold (III) halides and the like. These compounds are added to the bath in an amount sufficient to provide the desired amount of gold in the bath. The complexing agent, such as an alkali metal cyanide or an imide, is added to the bath in an amount sufficient to form the desired gold (III) complex in situ in the plating bath.

The imides which may be used to form the trivalent gold complexes, either in situ in the bath or for addition as such, have the general formula:

$$(1)\ \underbrace{RNCHO}\ \text{or}\ (2)\ \underbrace{RCONHCO}$$

in which R is a radical selected from the group consisting of alkylene, substituted alkylene, arylene and substituted arylene.

In the case of imides of the formula (1), above, R is preferably a substituted arylene, such as sulfonyl-o-phenylene ($—SO_2—C_6H_4—$), and the imide formed will be sulphobenzoic imide, (ie, saccharin or o-benzosulfimide) $C_6H_4(SO_2)$ (CO)—NH. In the case of imides of the formula (2), above, R is preferably alkylene, such as $C_2H_4$ and the imide formed is succinimide or R is arylene, such as $C_6H_4=$ (o-phenylene) and the imide formed is phthalimide.

The trivalent gold complex will be present in the bath in an amount sufficient to effect the deposition of gold on the substrate, up to the maximum solubility of the complex in the bath. Typically, the complex will be present in an amount sufficient to provide a gold content in the bath from about 0.25 to 20 grams/liter, with an amount sufficient to provide about 0.5 to 10 grams/liter being preferred.

As used herein, the term "alkali metal" is intended to include sodium, potassium, lithium, rubidium and cesium, as well as ammonium. Although, in many instances, the preferred alkali metal is potassium, the other "alkali metals" enumerated many also be used with comparable results.

The term "organic carboxylic acid" is intended to encompass monocarboxylic and polycarboxylic acids, as well as amino carboxylic acids. In general, the monocarboxylic and polycarboxylic acids will typically have 1 to 8 carbon atoms, 1 to 4 carboxyl groups and 1 to 6 hydroxyl groups. Exemplary of such acids which may be used are acetic acid, citric acid, tartaric acid, benzoic acid, oxalic acid, ascorbic acid, isoascorbic acid, gluconic acid, glucoheptanic acid, glycollic acid, glutamic acid and the like.

The amino carboxylic acids are typically similar to the mono- and polycarboxylic acids described above, but also containing 1 to 2 amine groups. Exemplary of such acids which may be used are glycine, alanine, valine, leucine, aspartic acid, glutamic acid, serine, lysine, arginine, threonine, phenylalanine, and the like.

The plating baths of the present invention may contain a mineral acid in addition to or in place of the organic carboxylic acids. Typical of such mineral acids which may be used are hydrochloric acid, sulfuric acid, phosphoric acid and the like.

The organic carboxylic acid and/or the mineral acid will be present in the plating bath in amounts sufficient to maintain a bath pH of 0.1 to 6.0 and preferably 0.2 to 4.0. Typically, the organic carboxylic acid will be present in amounts up to about 50 grams/liter and the mineral acid in amounts up to about 600 grams/liter, with amounts of about 1 to 40 grams/liter and 10 to 300 grams/liter, respectively being preferred.

For most operations the bath will be maintained at a temperature of from about 20 degrees to 95 degrees C., preferably from about 40 degrees to 85 degrees C. Immersion times for the substrate being plated will vary widely depending of course upon such factors as the type of substrate, the deposit thickness required and the like. Immersion times of about 5 minutes to 4 hours to produce plating thickness of 0.5 to 12 microns are typical.

As also previously noted, the immersion may also contain metal catalytic components such as cobalt, nickel or iron present in the bath for certain plating, although it is preferred to operate a non-catalytic immersion gold plating bath. When such catalysts are employed the metal ions are furnished by such ionizable components as salts e.g., sulfates, chlorides, phosphates, and the like.

One of the special advantages of the electroless baths of the present invention is that they produce excellent gold deposits on a variety of substrates. The exact mechanism of why the relatively simple baths containing the trivalent gold components work so effectively is, however, not fully understood at the present time.

Aside from nickel metal other substrates useful in the present invention are nickel alloys, copper, copper alloys, tungsten, molymanganese, and the like. An important aspect of the present invention is to utilize metallized ceramic substrates. Examples of such metallized substrates are screen printed molymanganese, tungsten, electroless nickel, copper on ceramics such as alumina, alumina-berylia, and other conventional bases.

For many purposes it is desirable for the substrate to be precleaned prior to plating. Thus, for example, a metallized ceramic is degreased by subjecting it to soaking it clean in a hot alkaline solution for 5–10 minutes followed by a water rinse. The resulting degreased substrate is then dipped in hydrochloric acid (20%) solution at 120° F. with a subsequent cold water rinse. Ultrasonic cleaning is recommended occassionally in place of the foregoing degreasing treatment for molybdenum manganese and tungsten substrates. In some instances the metal substrate may be pretreated by merely heating the substrate to a temperature of 100° to 800° C. for a limited period of time. It will be understood, however, that the exact method of precleaning or pretreating the substrate is neither critical nor a feature of the present invention.

The exact electrodeposition procedure may also vary according to the substrate being treated as well as upon the results desired. Although a single immersion will be sufficient for most platings, it is possible to utiliza a two step immersion process. Thus, for example, the substrate is initially placed in the immersion gold plating bath for one hour, dried, and then fired at 400°–900° C. for 3 to 10 minutes in a gas foaming/hydrogen atmosphere. The resulting, partially plated substrate, is immersed in the bath again for up to 3 hours and fired as before to obtain the outstanding adhesion as well as the desired thickness.

The present invention will be more fully understood by reference to the following illustrative embodiments:

EXAMPLE I

An electroless plating bath was formulated from the components set forth below:

| Components | Amount g/l |
|---|---|
| Gold, as potassium auricyanide | 4.0 |
| Citric acid | 15.0 |
| Hydrochloric acid (37%) | 100 ml/l |

A precleaned ceramic substrate metallized with molymanganese was immersed in the bath, operated at 65 degrees C., for a period of two and a half hours. The resulting gold deposit had a thickness of 2 to 2.5 microns and adhered firmly to the substrate without any evidence of cracking. Furthermore, good bath stability was observed throughout the plating procedure.

EXAMPLE II

A series of electroless plating baths were formulated as follows:

| Components | Amounts g/l |
|---|---|
| Gold, as potassium auricyanide | 2.0 |
| Citric Acid | 20.0 |
| Hydrochloric Acid (37%) | 100 ml/l |

Nickel ions were added to these baths, as nickel chloride to provide varying nickel ion contents of from 0.01 to 5.0 g/l.

Electroless nickel substrates, which had been preheated to a temperature of about 850 degrees C. in hydrogen, were immersed in these baths, operated at a temperature of about 80 degrees C., for about 1 hour. The resulting deposits were about 2 microns in thickness.

EXAMPLE III

Another gold metal electroless plating bath was prepared with the following constituents:

| Components | Amounts g/l |
|---|---|
| Gold, as potassium gold sulfobenzoic imide | 4.0 |
| Hydrochloric acid (37%) | 100 ml/l |

A tungsten substrate, precleaned to remove oxides, was immersed for about 1 hour at a solution temperature of 80° C. The resulting deposit of about 2.5 microns.

EXAMPLE IV

An electroless plating bath was prepared with the following constituents:

| Components | Amounts g/l |
|---|---|
| Gold, as potassium aurate | 6 |
| Potassium cyanide* | 8 |
| Citric acid | 40 |

*Added to convert the potassium aurate to potassium auricyanide

An oxide-free copper substrate was immersed in the solution at a temperature of 50° C. to obtain a gold deposit of 1.0 microns in about 1 hour. The above data show that the improved electroless baths of this invention not only overcome problems associated with prior art electroless baths but also lead to outstanding results in the quality and thickness of the gold deposits on a variety of substrates. Good bath stability was maintained. The electroless baths of this invention will have wide and unique applications such as in the electronic industry and can be utilized with the same techniques commonly used in racking and barrel plating.

It will be further understood that the foregoing examples are illustrative only, and that variations and modifications may be made without departing from the intended scope of this invention.

What is claimed is:

1. A process for electroless plating gold on a substrate which comprises immersing such substrate in an electroless gold plating bath which comprises a trivalent gold complex selected from alkali metal auricyanides and alkali metal auric imides in an amount which is at least sufficient to deposit gold on the substrate up to the maximum solubility of the complex in the bath, and at least one of the following ingredients:

(a) an organic carboxylic acid, and (b) a mineral acid in amounts sufficient to adjust the pH of the bath to from about 0.1 to 6.0 and maintaining such substrate immersed in said bath, without the passage of electrical current therethrough, for a period of time sufficient to form an immersion deposit of gold on said substrate.

2. The process of claim 1 wherein the alkali metal is potassium.

3. The process of claim 1 wherein the organic carboxylic acid is selected from the group consisting of acetic acid, citric acid, tartaric acid, oxalic acid, ascorbic acid, and aminio carboxylic acids.

4. The process of claim 3 wherein the organic carboxylic acid is citric acid.

5. The process of claim 1 wherein the mineral acid is selected from the group consisting of hydrochloric acid, sulfuric acid, and phosphoric acid.

6. The process of claim 5 wherein the mineral acid is hydrochloric acid.

7. The process of claim 1 wherein the bath additionally contains a catalytic amount of metal ions selected from the group consisting of cobalt, nickel, and iron ions.

8. The process of claim 7 wherein the electroless gold plating bath has the following composition:

| Component | Amount g/l |
|---|---|
| (a) Trivalent gold, as trivalent gold complex | 0.25–20 |
| (b) an organic carboxylic acid | 0–50 |
| (c) a mineral acid | 0–600 ml/l |
| (d) cobalt, nickel or iron ions | 0–10 |

wherein at least one of Components (b) and (c) are present in the immersion bath in an amount sufficient to maintain the bath pH in the range of about 0.2 to 4.0.

* * * * *